US011279553B2

(12) United States Patent
Tietze et al.

(10) Patent No.: US 11,279,553 B2
(45) Date of Patent: Mar. 22, 2022

(54) CONTAINER FOR STORING AND TRANSPORTING HEAT-SENSITIVE PRODUCTS

(71) Applicant: ARKEMA FRANCE, Colombes (FR)

(72) Inventors: Olaf Tietze, Ichenhausen (DE); Philippe Maj, Brignais (FR); Ralf Wittlinger, Guenzburg (DE); Martin Moellers, Guenzburg (DE)

(73) Assignee: ARKEMA FRANCE, Colombes (FR)

( * ) Notice: Subject to any disclaimer, the term of this patent is extended or adjusted under 35 U.S.C. 154(b) by 0 days.

(21) Appl. No.: 14/891,081

(22) PCT Filed: May 14, 2014

(86) PCT No.: PCT/FR2014/051117
§ 371 (c)(1),
(2) Date: Jan. 21, 2016

(87) PCT Pub. No.: WO2014/184491
PCT Pub. Date: Nov. 20, 2014

(65) Prior Publication Data

US 2016/0251154 A1 Sep. 1, 2016

(30) Foreign Application Priority Data

May 14, 2013 (FR) ..... 1354304

(51) Int. Cl.
*B65D 88/74* (2006.01)
*B65D 90/06* (2006.01)
(Continued)

(52) U.S. Cl.
CPC ..... *B65D 88/74* (2013.01); *B65D 85/50* (2013.01); *B65D 90/022* (2013.01);
(Continued)

(58) Field of Classification Search
CPC ..... B65D 88/74; B65D 85/50; B65D 90/06; B65D 88/742; B65D 88/744; B65D 88/745; B65D 90/046; B65D 90/04
(Continued)

(56) References Cited

U.S. PATENT DOCUMENTS 2,556,418 A * 6/1951 Del Mar ..... B65D 19/38 62/62
3,435,947 A 4/1969 Ezekiel
(Continued)

FOREIGN PATENT DOCUMENTS

FR 1 272 944 A 10/1961
FR 1 273 907 A 10/1961
(Continued)

OTHER PUBLICATIONS

International Search Report (PCT/ISA/210) dated Sep. 4, 2014, by the European Patent Office as the International Searching Authority for International Application No. PCT/FR2014/051117.
(Continued)

*Primary Examiner* — Don M Anderson
(74) *Attorney, Agent, or Firm* — Buchanan Ingersoll & Rooney P.C.

(57) ABSTRACT

The present invention relates to a container provided with heat insulation means (8), characterized in that the heat insulation means (8) are removable and consist of a partition having a multilayered structure, or films, arranged between the wall of the tank (5) and at least the walls of two of the above-mentioned sides (2, 2') as well as the upper surface (4) of the container (1). The invention further relates to the use of such heat insulation means (8) in a conventional container (1).

17 Claims, 2 Drawing Sheets

(51) Int. Cl.
*B65D 85/50* (2006.01)
*B65D 90/02* (2019.01)
*B65D 88/10* (2006.01)

(52) U.S. Cl.
CPC ..... *B65D 90/027* (2013.01); *B65D 90/06* (2013.01); *B65D 88/10* (2013.01)

(58) Field of Classification Search
USPC ..... 220/529
See application file for complete search history.

(56) References Cited

U.S. PATENT DOCUMENTS

| | | | | |
|---|---|---|---|---|
| 5,105,970 | A * | 4/1992 | Malone | B65D 90/06 206/523 |
| 5,632,400 | A | 5/1997 | Podd et al. | |
| 2005/0023278 | A1* | 2/2005 | Yong | B65D 90/046 220/1.6 |
| 2008/0197649 | A1 | 8/2008 | Geoffrey | |
| 2010/0018978 | A1* | 1/2010 | Osborne | B65D 90/046 220/495.01 |
| 2011/0291045 | A1* | 12/2011 | Gravelle | C08F 4/34 252/182.14 |
| 2013/0200082 | A1* | 8/2013 | McAndrew | B65D 81/38 220/592.2 |
| 2016/0251154 | A1 | 9/2016 | Tietze et al. | |

FOREIGN PATENT DOCUMENTS

| | | | |
|---|---|---|---|
| FR | 1 515 058 | A | 3/1968 |
| FR | 2 407 434 | A | 5/1979 |
| FR | 2 822 880 | A | 10/2002 |
| WO | WO 91/13818 | A1 | 9/1991 |
| WO | WO 2008/014572 | A1 | 2/2008 |
| WO | 2010046790 | A1 | 4/2010 |
| WO | 2014184491 | A1 | 11/2014 |

OTHER PUBLICATIONS

D8—Thermoauskleidung Oellerking, Testlauf mit Thermoauskleidung, Mar. 2011, 5 pages.

D9—Temperaturdaten Oellerking, 1905 Oellerking Schleswiger Tauerkfabrik—thermo inlets for 20' and 40' containers, Mar. 2011, 5 pages.

D10—Preisblatt Oellerking, Ollerking Thermoauskleidungen fur 20' and 40' ISO-Container, 1 page.

D11—Technische Oaten Oellerking, Technical Specifications Material for Thermo Liner, Dec. 2012, 1 page.

D12—Temax Isoliermatten, Broschure, laut Ludo Claes von Jul. 2013, Jul. 2013, 2 pages.

Notification of Opposition issued by the European Patent Office dated Aug. 13, 2019, in European Patent Application EP 2 996 967 B1, (Arkema France), (28 pages).

* cited by examiner

CONTAINER FOR STORING AND TRANSPORTING HEAT-SENSITIVE PRODUCTS

FIELD OF THE INVENTION

The subject of the invention is a means for transporting heat-sensitive products without danger or degradation, notably in regions where exposure to very high temperatures is unavoidable. The invention relates more particularly to a metal container for storing and transporting heat-sensitive products.

By way of examples of heat-sensitive products mention must be made of organic peroxides (or, more generally, chemical compounds able to start and/or encourage the polymerization/cross-linking of polymers) for which the present invention is particularly intended to provide a solution. This is because special safety precautions have to be taken when storing and transporting organic peroxides, more particularly associated with the temperature of said peroxides (which are often present in liquid or even pasty form).

Organic peroxides which have particularly low decomposition temperatures are advantageously packaged in the form of an aqueous emulsion containing an antifreeze, said antifreeze allowing the emulsion to be kept in liquid form at temperatures below −10° C., preferably below −20° C. These negative temperatures make it possible to prevent the uncontrolled decomposition of said peroxides during the storage and transport operations. The presence of water, as a heat-transfer fluid, means that the energy generated in the event of any decomposition of said peroxides can be absorbed and dissipated.

At the opposite end of the scale from the (very) low temperatures, organic peroxides are also transported in hot regions such as, for example, in the Middle-East region. Furthermore, this transportation unavoidably involves periods of storage in places that are particularly hot, particularly on account of their exposure to the rays of the sun.

PRIOR ART

Chemical products are traditionally transported in conventional metal containers in which the temperature very soon, according to extreme environmental conditions, becomes very high.

When the products transported and stored in the metal container are particularly sensitive to high temperatures and exhibit a risk of igniting or even of exploding, the metal containers are fitted with refrigeration plant. There are also extremely complex thermal insulation systems which are lengthy and expensive to install in the container.

Such refrigeration systems or complex thermal insulation systems are for example disclosed in the following documents: FR 1272944, FR 1273907, FR 1515058, FR 2407434 and FR 2822880.

All of these systems are particularly expensive because of the cost of installing them and/or of the necessary cost to provide them with power, and often require significant and irreversible conversion/adaptation of the container. As a result, the availability of such containers is limited and is unable to absorb occasional peaks in demand.

At the present time it is necessary, for transporting and storing heat-sensitive products such as peroxides, to propose a system that is flexible and inexpensive while at the same time being absolutely reliable with regard to its prime function of providing thermal insulation.

BRIEF DESCRIPTION OF THE INVENTION

The applicant company has discovered an insulation system that is particularly well suited to transporting and storing heat-sensitive products such as peroxides in the containers conventionally used. This thermal insulation system, which is removable and requires no power supply, keeps the temperature of these products below their operability temperature limit above which the risks of said products becoming degraded or even exploding become significant.

The present invention thus relates to a container for storing and transporting heat-sensitive products, the container having two parallel longitudinal sides and two parallel lateral sides and two, upper/lower, faces, the container, preferably made of metal, comprising at least one reservoir, preferably thermoplastic, intended to house heat-sensitive products such as, in particular, polymerization and/or cross-linking initiators, said container comprising at least one opening intended to allow the reservoir containing said heat-sensitive products to be inserted and withdrawn, and thermal insulation means, characterized in that the thermal insulation means are removable and consist of a partition with a multilayer or film structure, positioned between the wall of the reservoir and at least the walls of two of the aforementioned sides and the upper face of the container.

The following aspects and features of the invention are:

- advantageously, the thermal insulation means are positioned between the aforementioned four sides of the container and the reservoir;
- according to one advantageous aspect of the invention, the partition is positioned some distance from each of said walls so as to form two air chambers respectively between the walls of the container and the partition and between the partition and the wall of the reservoir;
- advantageously, the distance between the wall of the reservoir and the partition is at least two centimeters, preferably at least five centimeters;
- likewise, the distance between the partition and the walls of the side or of the face of the container is at least one centimeter, preferably at least three centimeters;
- according to one preferred embodiment of the invention, the thermal insulation means are fixed mechanically to the container by a plurality of catching and engagement points present on the thermal insulation means and on the container respectively;
- more specifically, the catching points consist of hooks intended to engage in a plurality of corresponding engagement points positioned on the walls of the container;
- also, the catching points of the thermal insulation means protrude and are at least partially surrounded by a thermally insulating material;
- for preference, one of the films of the multilayer partition consists of a metallic film, preferably made of aluminum, said metallic film preferably forming an external layer of said multilayer structure. In this embodiment, this metallic film has a heat reflecting capacity of at least 95%.
- advantageously, the multilayer partition (8) has at least three thermoplastic and/or thermoset films;
- more specifically, one of the films is made of polyethylene and another film is made of polyester;

advantageously, at least one of the films of the multilayer partition has an air bubble structure;

according to one particularly advantageous aspect of the invention, the thermal insulation means are able to keep the heat-sensitive products contained in the (thermoplastic) reservoir at a temperature below 60° C., preferably below 50° C. and, more preferably still, below 45° C.

The invention also relates to the use of means for thermally insulating a reservoir positioned in a container for storing and transporting heat-sensitive products, such as, in particular, polymerization and/or cross-linking initiators, the container, preferably made of metal, having two parallel longitudinal sides and two parallel lateral sides and two, upper/lower, faces, the container comprising at least one reservoir, preferably thermoplastic, intended to house heat-sensitive products, said container comprising at least one opening intended to allow the reservoir, preferably thermoplastic, containing said heat-sensitive products to be inserted and withdrawn, and thermal insulation means, characterized in that the thermal insulation means are constituted or positioned as claimed in any one of the preceding claims.

The thermal insulation means can in fact be used to particularly good effect with all types of containers, particularly the metal containers conventionally used at the present time for transporting and storing all types of products.

The invention offers the following advantages:

the thermal insulation means are removable and can be mounted in and dismantled from a container by a (single) operator in a very short space of time;

the thermal insulation means can be fitted and fixed without any modification to the conventional metal container used at the present time;

the thermal insulation means avoid any conduction of heat between the metal container and the thermoplastic reservoir;

the thermal insulation means have a structure allowing them to reflect at least 95% of the heat coming in from outside (the thermal insulation means at least partially envelop a volume forming the thermally insulated enclosure in which, in the present invention, the reservoir containing the heat-sensitive products is placed);

the insulation means according to the invention require no source of power (as opposed notably to the cooling systems such as cold rooms or the like);

the insulation means are fixed and positioned in such a way that they form two air chambers each one forming a thermally insulating layer sandwiching the thermal insulation means.

The description which follows, connected with the attached figures, is given solely by way of nonlimiting illustration.

DETAILED DESCRIPTION OF THE INVENTION

Figure 1:
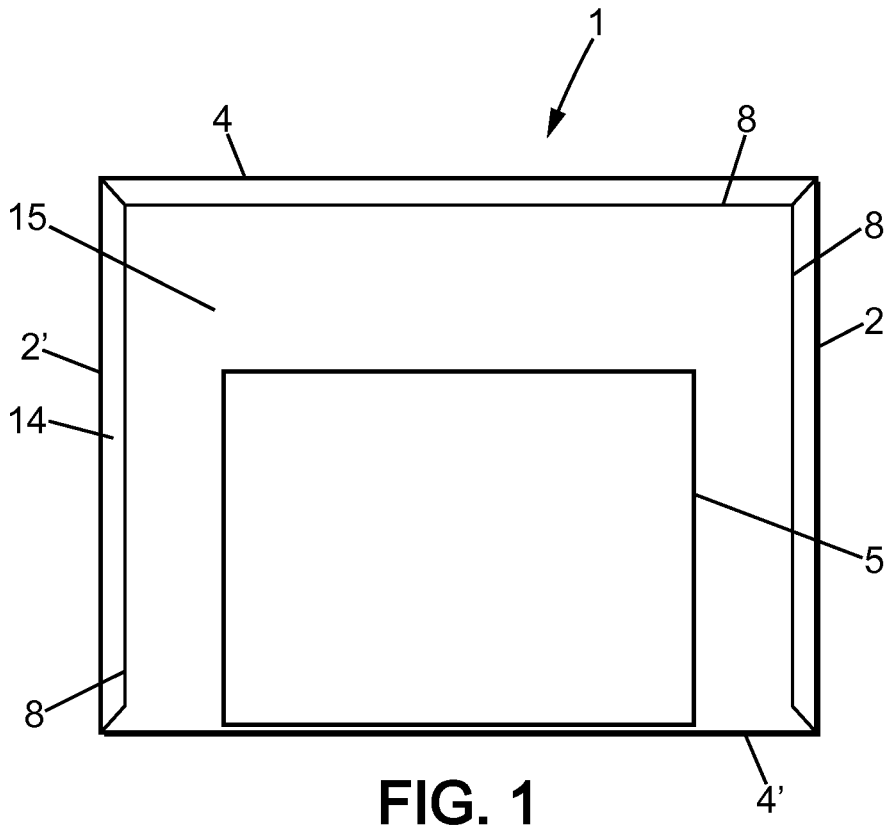
FIG. 1 is a cross section illustrating the thermal insulation means positioned and fixed in a conventional metal container.
Figure 2:
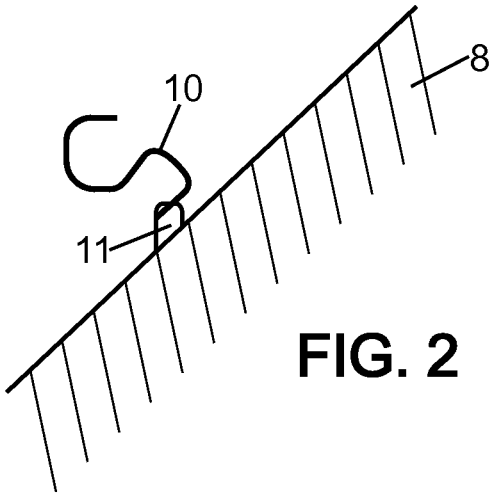
FIG. 2 is a detailed view of a catching element of the thermal insulation means.

The container 1 is a conventional metal container. This container 1 has two parallel longitudinal sides 2, 2' and two lateral sides 3 which are perpendicular to said longitudinal sides, the longitudinal sides 2, 2' having larger dimensions than the lateral sides 3. It also comprises two faces, an upper 4 and a lower 4', such that obviously this type of container 1 is closed, notably when goods or products are being transported.

Because the container 1 is intended to receive products/goods and/or one or more reservoir(s) 5 or the like containing such products directly, it in the conventional way has an opening 6. This opening 6 is visible here in FIG. 4 and consists of two doors 7, 7' of the container 1, opening and closing one of the two lateral sides 3 thereof.

The container 1 also in the conventional way has walls the cross section of which exhibits a substantially corrugated shape so as notably to provide better mechanical impact resistance.

The present invention advantageously makes use of this conventional structure of the metal containers 1 insofar as it makes it possible to create an air chamber between the walls of the container 1 and the thermal insulation means 8.

The container 1 in the conventional way comprises at least one vent, generally situated on the upper face 4 thereof, allowing a certain exchange of air between the inside of the container 1 and the external environment. The opening of this vent is often adjustable and may even be blanked off completely.

Figure 3:
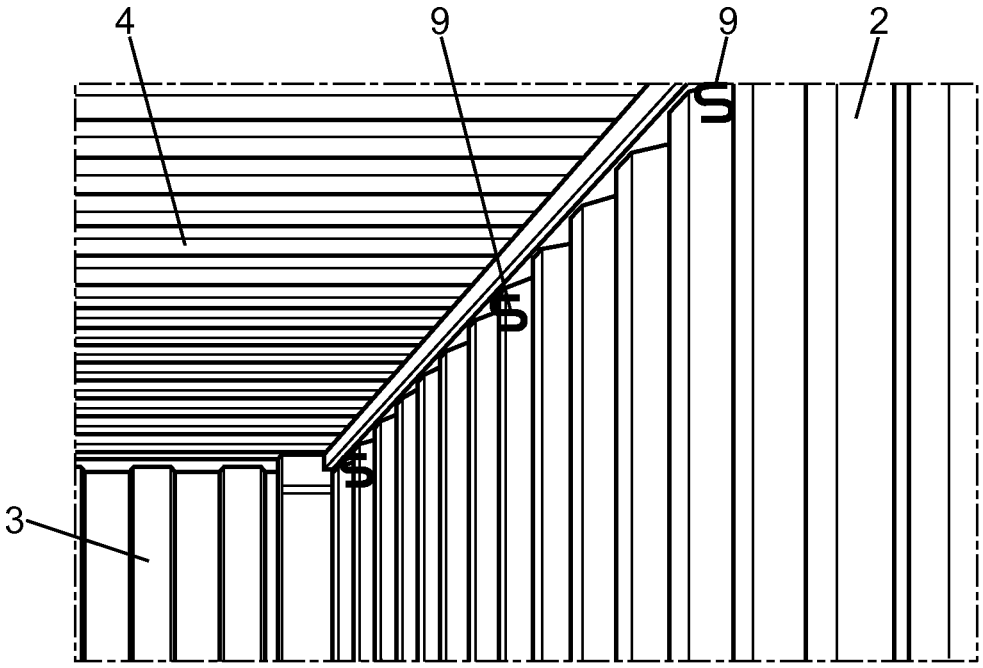
FIG. 3 is a detailed view of the engagement elements present in a metal container.

This type of container 1 in the conventional way comprises engagement means 9, such as those visible in FIG. 3. Catching means 10, present on the thermal insulation means 8, and consisting of curved hooks, allow the thermal insulation means 8 to be removably mechanically fixed to the container 1 via the engagement means 9 thereof, which are spaced apart and are present in the conventional way near the junction between the upper face 4 and the sides 2, 2' or 3. In that way, a single operator can easily fix the thermal insulation means 8 in the container 1, the catching means 10 ideally being present in equal number to the engagement means 9 present in the container 1. Nevertheless, it is conceivable for the container to be equipped with (additional) such engagement means 9, using removable engagement means fixed to the container 1 for example by a nut or the like or even by bonding.

It should be noted that the thermal insulation means 8 do not necessarily have fixing means in the lower part, the panels of thermal insulation, consisting of the multilayer partition, extending vertically until they touch the lower face 4' of the container 1. Of course, engagement means 9 and catching means 10, possibly having elastic (or sprung) parts, may also be envisioned respectively for the walls of the container 1 and the thermal insulation means 8.

The insulation means 8 also have, at each catching means 10 a protruding part 11 that fixes said means, this protruding part 11 advantageously being made of a thermally insulating material. Indeed it has been found that it is particularly important to avoid any physical contact with the (metal) walls 2, 2', 3 of the container 1 because these walls, by their very nature, heat up very quickly when the containers are placed in an environment that is at a (very) high temperature. The thermal insulation means 8 according to the invention advantageously, because of their attachment and arrangement in the container 1, make it possible to avoid any thermal conduction of heat between the walls 2, 2', 3 and 4 of the container 1 and the product reservoir 5.

Figure 4:
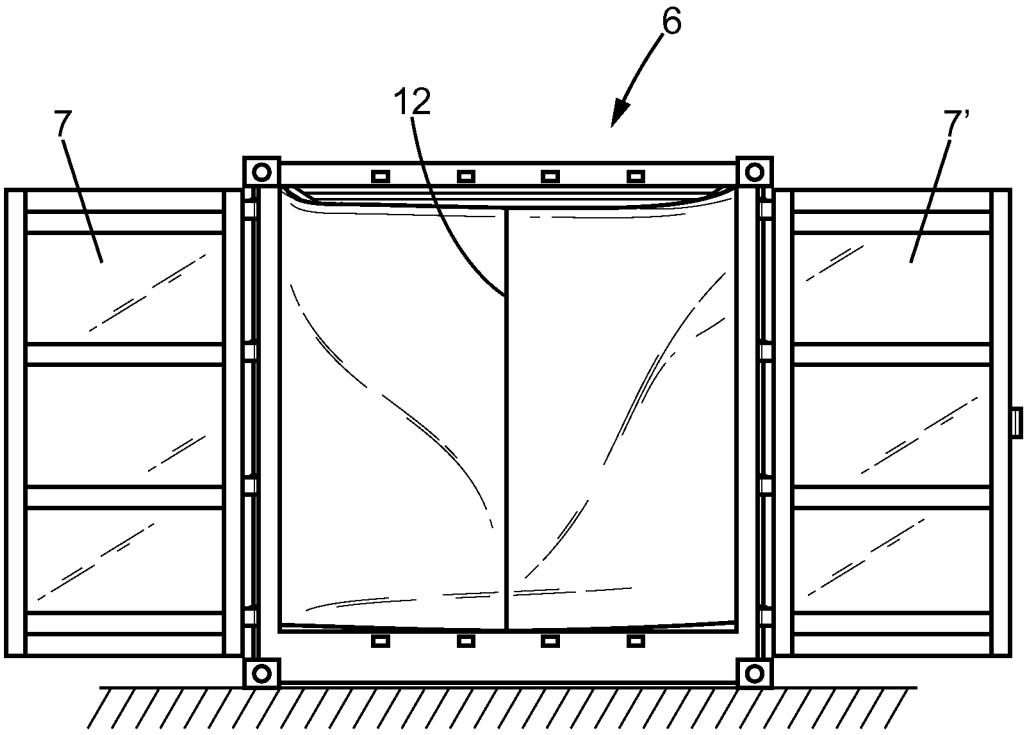
FIG. 4 is a front view of the metal container, with the doors open, in which the thermal insulation means have been installed.

The thermal insulation means 8 may be installed so that they cover (over) at least the two longitudinal sides 2, 2' and the upper face 4. Nevertheless, advantageously, the thermal insulation means 8 will extend between the reservoir 5 and the four sides 2, 2' and 3. On that assumption, on the lateral face 3 that has the opening of the container 1, the thermal insulation means 8 will easily be able to split apart in the manner of the doors 7, 7' of the opening of the container 1, for example by means of a zip fastener 12 that allows an operator to open the thermal insulation means 8 on this side 3 without having to completely remove these means 8. FIG. 4 schematically illustrates the lateral side 3 of the container 1 where the opening is situated and the thermal insulation means 8 are visible with the zip fastener 12 extending vertically over the entire height so as to allow said means 8 to be opened in exactly the same way as the two doors 7, 7' of the opening of the container 1.

It is considered here that a good thermally insulating material, in terms of conduction, has at least a thermal conductivity, expressed in $W.m^{-1}.K^{-1}$ (watts per meter per Kelvin) at 20° C., that is below 0.1 $W.m^{-1}.K^{-1}$, and preferably below 0.05 $W.m^{-1}.K^{-1}$.

The thermal insulation partition 8 consists of a multistructure web or fabric, which means to say one made up of a plurality of layers or films fixed together. The thermal insulation means 8 are ideally formed of a plurality of adjacent layers or films each having heat-barrier properties, whether this be in terms of radiation, convection or even conduction, but also having a synergistic thermal insulation effect on account of these various layers or films being combined in a clearly determined order.

Of course, one essential aspect of the present invention is that these thermal insulation means 8 are lightweight and relatively flexible so that a single operator can, without difficulty, fit, arrange and fix said means 8 in the container 1.

Furthermore, mechanical means, such as hooks or the like, may be present over the entire interior surface of the container 1 and collaborate with anchoring means situated on the thermal insulation means 8 so as to keep this multilayer structure taut and effectively provide two thermal insulation chambers 14, 15 of substantially constant volume. Indeed, one of the key objectives of the present invention is to offer two thermal insulation chambers each filled with air (which per se forms a good means of thermal insulation), which are separated by an excellent thermal insulation means, in this instance the multilayer structure according to the invention.

The air chamber 15 may potentially be filled with a refrigerating gas able to cool this section and, in particular, the reservoir 5 containing the heat-sensitive materials. This solution is conceivable because of the imperviousness of the multilayer structure 8.

Thus, whatever the external conditions, and therefore the surrounding conditions to which the reservoir is subjected, the heat-sensitive substance it contains will not increase in temperature, or will not do so beyond a critical threshold.

The exterior wall of the thermal insulation means 8 is advantageously made of a metallic material that is an excellent reflector of heat diffused by radiation. Such a material may be aluminum. Thus, this metallic material may be located at the two ends of the sandwich formed by the multilayer structure of the thermal insulation means 8 or at the very least present on the exterior side (forming the layer or film closest to the walls 2, 2', 3 or 4 of the container 1).

Apart from the metallic outer layer, which may be present on both sides of the multistructure, all the other layers or films are excellent thermal insulators (having zero or very low thermal conductivity) in terms of the definition given hereinabove.

Thus, one of the layers of the thermal insulation means 8 will advantageously be made of polyethylene and another layer will be made of polyester. Of course, these elements may be replaced with other polymer materials that have excellent thermal insulation properties, such as polyurethane foam or expanded polystyrene for example.

Furthermore, the thermal insulation means may advantageously comprise a layer with air bubbles, conventionally made of polyethylene, because such a layer forms a very good thermal insulator.

Finally, one advantageous aspect of the invention lies in the creation of two air chambers 14, 15 (excellent thermal insulation) obtained by the particular way of installing the thermal insulation means 8 according to the invention. Thus, there is an air chamber 14 between the walls of the container 1 and the thermal insulation means 8 and between the insulation means 8 and the reservoir or reservoirs 5. This arrangement also avoids the creation of points of thermal conductivity, or in other words points of contact between the reservoir(s) 5 and the walls 2, 2', 3 or 4 of the container 1, the latter being at the highest temperatures.

Tests have been carried out by the patentee. Three metal containers, each having a different interior volume and possessing a reservoir 5 containing a control liquid comprising temperature measurement means were fitted, in the case of two of them, with the thermal insulation means 8 according to the invention, the third being left without additional insulation by way of control. These thermal insulation means 8 were fitted and fixed inside the container 1 in accordance with the prescribed use for the said means 8.

These three containers 1 were stored temporarily in a hot region, more specifically in the Middle East, for several days and it was found that the liquids in the two insulated containers never reached a temperature higher than 50-60° C., and more specifically that the temperature of the liquid was always below 45° C. By contrast, the liquid in the reservoir of the non-insulated container reached a temperature of 62° C., the air temperature around the reservoir having exceeded 70° C. for a few hours.

It is evident from the tests that, contrary to what could be expected of a passive thermal insulation device (one that does not consume energy) the results are particularly attractive insofar as they allow temperatures compatible with the safety of heat-sensitive products of the peroxide type to be maintained even during transport and storage in extremely hot regions.

The invention claimed is:

1. A thermal insulator for a container, comprising: a thermal insulator partition, the thermal insulator partition comprising a multilayer structure including at least three thermoplastic and/or thermoset films and a metallic film, wherein at least one of the at least three thermoplastic and/or thermoset films comprises an air bubble structure, wherein: the thermal insulator partition is removably securable to an inside surface of the container so as to provide a first air chamber between the thermal insulator partition and the inside surface of the container and a second air chamber between the thermal insulator partition and a reservoir placed within the container, wherein said reservoir contains organic peroxides; the thermal insulator partition is removably securable to the inside surface whether the reservoir is present within the container or absent from the container, wherein the thermal insulator partition further comprises a plurality of catching points configured to mechanically fix the thermal insulator partition to engagement points on the container in order to keep the thermal insulator partition taut and maintain the first air chamber and/or the second air chamber at a substantially constant volume when mechanically fixed to the container.

2. The thermal insulator of claim 1, wherein:

the container comprises a first side, a second side, a top surface, and a bottom surface, the thermal insulator comprises a plurality of thermal insulator partitions, each thermal insulator partition capable of being removably securable to one of the first side, the second side, the top surface, and the bottom surface.

3. The thermal insulator of claim 1, wherein the first air chamber is at least one centimeter and the second air chamber is at least two centimeters.

4. The thermal insulator of claim 1, wherein each catching point comprises a hook configured to engage a corresponding engagement point positioned on the inside surface of the container.

5. The thermal insulator of claim 1, wherein each catching point of the thermal insulator is configured to protrude from the thermal insulator partition and is at least partially surrounded by a thermally insulating material.

6. The thermal insulator of claim 1, wherein at least one of the at least three thermoplastic and/or thermoset films comprises polyethylene and at least one of the at least three thermoplastic and/or thermoset films comprises polyester.

7. The thermal insulator of claim 1, wherein the metallic film has a heat reflecting capacity of at least 95%.

8. The thermal insulator of claim 1, wherein each of the at least three thermoplastic and/or thermoset films has a thermal conductivity below 0.1 W m-1 K-1 at 20° C.

9. The thermal insulator of claim 1, wherein each of the at least three thermoplastic and/or thermoset films has a thermal conductivity below 0.05 W m-1 K-1 at 20° C.

10. A method for providing thermal insulation for a reservoir positioned in a container, the method comprising: removably securing a thermal insulator partition to an inside surface of a container so as to provide a first air chamber between the thermal insulator partition and the inside surface of the container and a second air chamber between the thermal insulator partition and a reservoir placed within the container, wherein the reservoir contains organic peroxides, wherein the thermal insulator partition comprises multilayer structure including at least three thermoplastic and/or thermoset films and a metallic film, wherein at least one of the at least three thermoplastic and/or thermoset films comprises an air bubble structure, wherein the thermal insulator partition is removably securable to the inside surface whether the reservoir is present within the container or absent from the container, wherein removably securing the thermal insulator partition comprises mechanically fixing the thermal insulator partition to the inside surface of the container via a plurality of catching and engagement points which keep the thermal insulator partition taut and maintain the first air chamber and/or the second air chamber at a substantially constant volume.

11. The method of claim 10, wherein the container comprises a first side, a second side, a top surface, and a bottom surface, the method further comprising:

removably securing a first thermal insulator partition to the first side, a second thermal insulator partition to the second side, a third thermal insulator partition to the top surface, and a fourth thermal insulator partition to the bottom surface.

12. The method of claim 10, wherein the first air chamber is at least one centimeter and the second air chamber is at least two centimeters.

13. The method of claim 10, further comprising at least partially surrounding each catching point with a thermally insulating material.

14. The method of claim 10, further comprising filling the second air chamber with a refrigerating gas.

15. A system comprising a thermal insulator and a container, wherein the system is configured for transporting heat-sensitive peroxides, wherein the thermal insulator comprises a thermal insulator partition, the thermal insulator partition comprising a multilayer structure including at least three thermoplastic and/or thermoset films and a metallic film, wherein at least one of the at least three thermoplastic and/or thermoset films comprises an air bubble structure, wherein the thermal insulator partition is removably securable to an inside surface of the container so as to provide a first air chamber between the thermal insulator partition and the inside surface of the container and a second air chamber between the thermal insulator partition and a reservoir placed within the container, wherein the reservoir contains organic peroxides, wherein the second air chamber is filled with a refrigerating gas.

16. The system of claim 15, wherein the system further comprises a plurality of catching and engagement points configured to mechanically fix the thermal insulator partition to the container in order to keep the thermal insulator partition taut and maintain the first air chamber and/or the second air chamber at a substantially constant volume when mechanically fixed to the container.

17. The system of claim 15, wherein the thermal insulator partition comprises a first thermal insulator partition configured to be removably securable to a first side of the container, a second thermal insulator partition configured to be removably securable to a second side of the container, a third thermal insulator partition configured to be removably securable to a top face of the container, and a fourth thermal insulator partition configured to be removably securable to a bottom face of the container.

* * * * *